United States Patent [19]

Stearns et al.

[11] Patent Number: 4,832,675

[45] Date of Patent: May 23, 1989

[54] TRAY FORMING APPARATUS

[75] Inventors: Norman K. Stearns, Glenmore; William K. Wagoner, Downingtown; Randy Long, Honey Brook; Frank DiMarzio, Glenmore, all of Pa.

[73] Assignee: Dopaco, Incorporated, Downingtown, Pa.

[21] Appl. No.: 72,145

[22] Filed: Jul. 10, 1987

[51] Int. Cl.[4] ..... B31B 3/46; B31B 9/62

[52] U.S. Cl. ..... 493/128; 493/124; 493/143; 493/167

[58] Field of Search ..... 493/122, 123, 128, 143, 493/167

[56] References Cited

U.S. PATENT DOCUMENTS

| | | | |
|---|---|---|---|
| 3,618,481 | 11/1971 | Odenhagen | 493/167 |
| 3,618,482 | 11/1971 | Bowman | 493/123 |
| 3,815,483 | 6/1974 | Cajo | 493/167 |
| 3,854,385 | 12/1974 | Wallin | 493/143 |
| 4,256,025 | 3/1981 | Goda et al. | 493/160 |
| 4,289,491 | 9/1981 | Collura et al. | 493/124 |
| 4,295,839 | 10/1981 | Baker et al. | 493/143 |
| 4,368,095 | 1/1983 | Gross et al. | 156/497 |
| 4,490,129 | 12/1984 | Oakley | 493/8 |
| 4,522,618 | 6/1985 | Stannard | 493/143 |
| 4,581,005 | 4/1986 | Moen | 493/167 |
| 4,626,234 | 12/1986 | Oxborrow | 493/167 |

*Primary Examiner*—Frederick R. Schmidt
*Assistant Examiner*—William E. Terrell
*Attorney, Agent, or Firm*—Dennison, Meserole, Pollack & Scheiner

[57] ABSTRACT

In apparatus for the formation of a planar blank into a flanged container, vertically reciprocating breaker rods for engagement with peripheral edge panels of the blank for a downward breaking of the edge panels over fixed breaker blocks prior to an inward folding of the container walls. Horizontally reciprocating glue applicators deposit glue on the downwardly broken edge panels at portions thereof overlapping as the container is formed. The formed containers are sequentially fed into a forming chamber incorporating serrated wall-defining inner vertical surfaces which engage the flanges and retain the containers for progressive downward feeding. Vertically reciprocating setter bars engage and downwardly deflect the flanges of the chamber-received containers.

24 Claims, 8 Drawing Sheets

50
52
152
148
150
146
154
156
142
166
168
144
170
174
172
140
178
58
56
88
86
104
164
176
184
186
180
182

TRAY FORMING APPARATUS

BACKGROUND OF THE INVENTION

The folded cardboard trays or clamshell cartons commonly used in "fast food" packaging have basically consisted of a compartment or compartments defined by a flat bottom with peripheral walls either perpendicular to the bottom or angled slightly outward relative to the vertical. The formed tray is adapted for use either as an open container or to receive some form of closure. The clamshell carton basically comprises two generally similar walled chambers hingedly connected for pivotal closing of one upon the other.

Apparatus for high speed automated formation of such containers is known. In one form of apparatus, flat diecut blanks of paperboard or cardboard are held in a magazine feeder for a gravity feeding of the blanks toward a discharge end of the feeder. One or more vacuum plates, pivotally mounted on a swing arm, pull the blank from the magazine feeder, rotate the blank to a horizontal position, and lower the blank on the top of a compression or forming chamber.

After positioning the blank on the top of the compression chamber and retraction of the vacuum plate, glue tips rotate downward to apply glue at the defined points, four in a single compartment tray and eight in a dual compartment clamshell carton. Upon a retraction of the glue tips, a forming head lowers to push the blank through the top of the compression or forming chamber and define the tray or carton. As the formed container moves into the forming chamber it nests into the container folded immediately prior thereto. The sides of the forming chamber are defined by vertical smooth cylindrical rods which retain the formed containers as the containers, whether trays or cartons, are progressively moved downward as each succeeding container is formed. The formed containers are ultimately discharged from the bottom of the forming chamber with the duration of the time within the forming chamber being sufficient to allow the glue to set.

SUMMARY OF THE INVENTION

The present invention is broadly concerned with improved folded paperboard containers wherein the containers, whether a single compartment tray or a multiple compartment clamshell carton, include peripheral laterally projecting edge flanges for enhanced sealing and increased strength, possibly allowing for the use of lighter caliper board.

More specifically, the invention is concerned with apparatus particularly adapted to automatically and at high speed form flanged folded paperboard containers from diecut blanks. The apparatus of the invention basically modifies the known apparatus, heretofor used in the formation of containers without flanges, to accomodate blanks with flange-forming end panels and so manipulate the blank as to form the blank into a flanged container. Basically, the apparatus prebreaks or prefolds the flange panels of a positioned blank and applies glue thereto prior to a formation of the compartment or compartments. Immediately after formation of the compartment, bringing the flanges into glueing position, the apparatus applies pressure to the formed flanges as the containers are nested within the forming chamber. The forming chamber itself incorporates means for directly engaging the flanges for retaining the formed containers.

In the operation of the apparatus, after the blank with the defined flange panels is removed from the magazine feeder and placed over the forming chamber, the glue tips rotate to apply gule to the blank adjacent wall-securing glue tabs. Simultaneously therewith, and in accord with the invention, breaker bars or rods descend to engage and fold the flanges out of the plane of the blank about fixed breaker blocks, at which point four horizontally reciprocating flange glue-tips apply glue to the flanges. The flange glue-tip retract as a forming head is lowered pushing the blank through the top of the forming chamber and forming the container compartment or compartments. As the container moves into the forming chamber, it nests within the previously folded container. As the forming head reaches the bottom of its vertical stroke, a flange final-set assembly moves vertically downward to engage and set the formed flange or flanges in the correct position for nesting and glue bonding. The side walls of the forming chamber include vertically elongate rectangular bars with inner faces having horizontal serrations along substantially the full heighth thereof for directly engaging the outer edges of the flanges and retaining the formed containers as they are sequentially moved downward as each subsequent container is formed.

The apparatus of the invention provides features which modify and so adapt the known forming apparatus as to provide for a unique accommodation of flanged blanks and the formation thereof into flanged containers without affecting the speed of operation of the apparatus and while retaining major operational components and functional features of the known apparatus.

Particular objects and advantages of the invention will be better appreciated from the details of construction and operation as more fully hereinafter described.

DESCRIPTION OF PREFERRED EMBODIMENT

Figure 1:
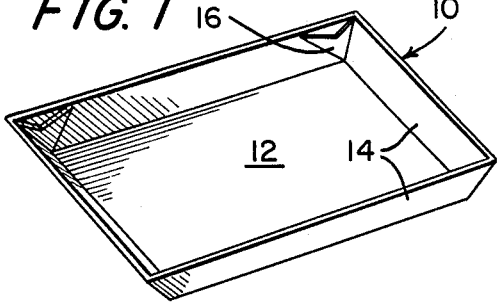
FIG. 1 PRIOR ART
FIG. 1 is a perspective view of a prior art single compartment folded paperboard tray.
Figure 2:
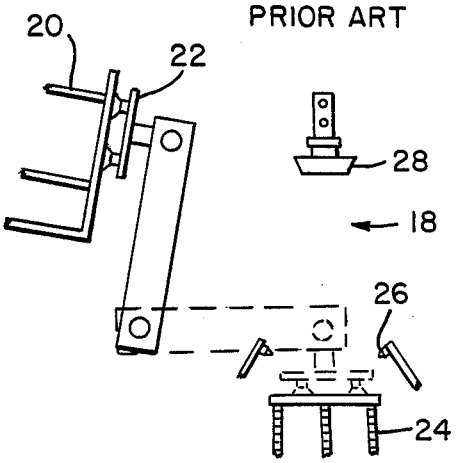
FIG. 2 PRIOR ART
FIG. 2 is a schematic illustration of apparatus used in the formation thereof.

Referring initially to FIGS. 1 and 2, the conventional folded paperboard container 10, illustrated as an open tray, includes a planar bottom 12 and upwardly and outwardly inclined side walls 14 joined by corner flaps 16.

Formation of the container 10 from a planar blank is normally effected by automated apparatus 18 schematically illustrated in FIG. 2. Basically, the appartus includes an inclined feed magazine 20 for the gravity feed of blanks, a pivotally mounted vacuum transfer head 22 for removing individual blanks and positioning the blanks in overlying relation to a forming chamber 24, glue applicators 26 for applying glue to the wall panels prior to folding of the blank, and a forming head 28. The forming head is synchronized with the vacuum transfer head and activated upon retraction of the transfer to forceably engage the blank and move the blank into the forming chamber with the side walls of the chamber, in the nature of elongate smooth cylindrical rods 30, inwardly folding the walls 14 on the blank with the glue tabs 16 positioned for an adhesive bonding of the walls 14 in their erected position. Each of the containers 10, formed by the descending forming head, seats within and is retained in the formed configuration by the previously formed containers with the stack of formed containers ultimately discharging below the pressure chamber 24 into an appropriate discharge chute or the like. The period of movement of the blanks through the forming chamber is such as to allow for a complete setting of the glue prior to discharge.

The present invention is concerned with unique modifications to the basic apparatus 18 of FIG. 2 to specifically adapt the apparatus to form a flanged container 32 using high speed manufacturing techniques. This container 32, formed of folded paperboard or the like, can be in the nature of an open single compartment tray, as illustrated, or a two compartment clamshell container.

The container 32, formed from a planar blank 34, includes a planar bottom panel 36, wall-defining panels 38 integral with the bottom panel 36 along defined fold lines and with appropriate corner glue flaps 40, and peripheral flange-defining panels 42 integrally joined along the outer edges of the wall panels 38 along appropriate fold lines. The flange panels 42 along the opposed pair of the longer side wall panels 38 are coextensive with the side wall panels. The flange panels 42 along the relatively shorter end wall panels have central notches 44 therein and terminate at the outer ends thereof adjacent the glue tabs 40 in inwardly directed flange glue flaps 46. As will be appreciated by a comparison of the blank 34 of FIG. 4 with the folded container 32 of FIG. 3, the glues tabs 40 and flaps 46 are partially severed from the one piece blank 34 and inwardly fold into appropriate overlying position respectively to the longitudinally elongate formed side walls and the associated flanges. In the formed container the walls thereof incline upwardly and outwardly and terminate in laterally outwardly directed flanges which parallel the bottom or bottom panel 36 of the container.

Figure 5:
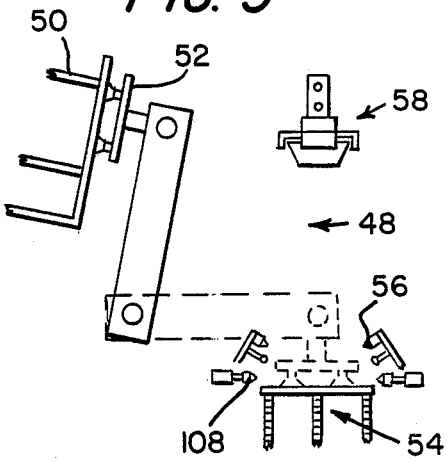
FIG. 5 is a schematic illustration of the apparatus of the invention used in the formation of the tray of FIG. 3.
Figure 14:
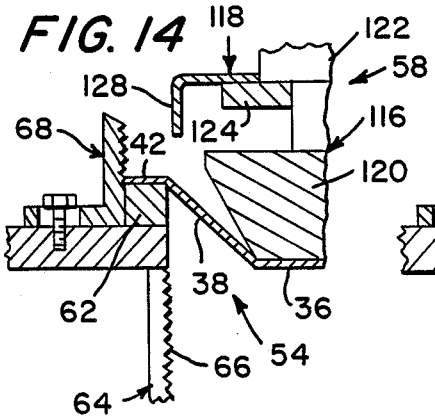
FIG. 14 is a cross-sectional detail taken substantially on a plane passing along line 14—14 in FIG. 9 and illustrating the forming assembly initiating the forming of a blank.

The apparatus 48 used in the formation of the container 32 is schematically illustrated in FIG. 5 and includes an inclined gravity feed magazine 50 for the planar blanks 34, a vacuum transfer head 52, a compression of forming chamber 54, glue applicators 56 and a forming head assembly 58.

The appartus 48 differs from the prior art apparatus 18 in several significant aspects associated with the formation of the container flanges as will be described subsequently.

Figure 6:
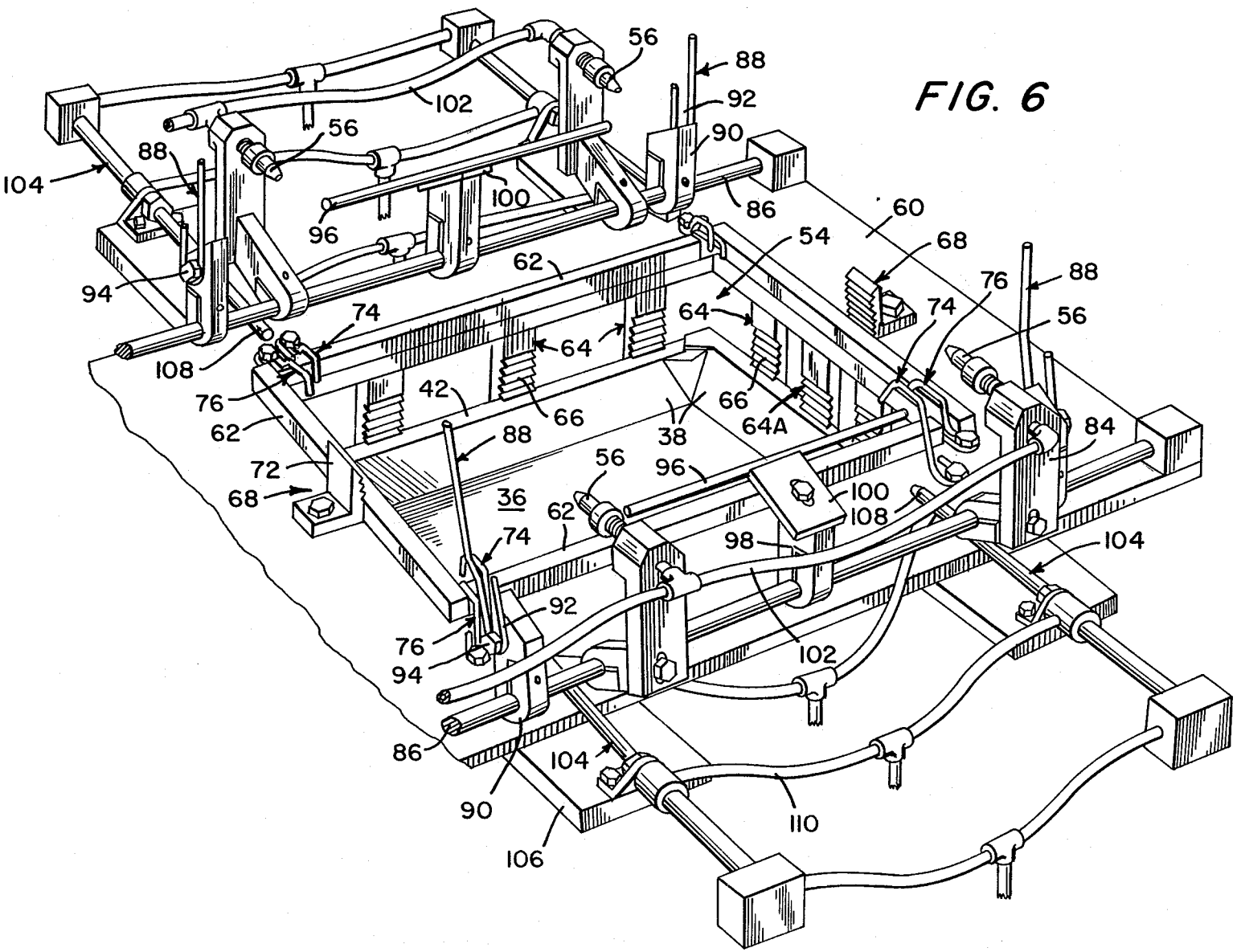
FIG. 6 is a perspective view of the forming portion of the apparatus with the compression of forming chamber exposed.
Figure 10:
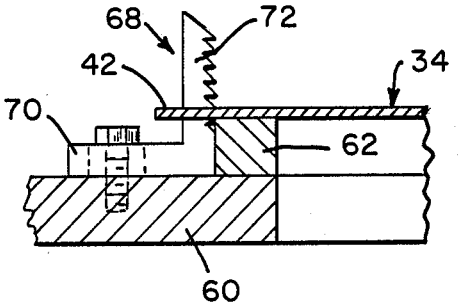
FIG. 10 is a cross-sectional detail taken substantially on a plane passing along line 10—10 in FIG. 7 and illustrating the blank positioned on top of the breaker blocks about the forming chamber.

Initially, attention is directed to FIG. 6 which illustrates the forming chamber 54 opening upwardly through a base plate 60. The chamber 54 is rectangular and has the open upper end thereof defined by four shoulder or breaker blocks 62 fixed to the upper base 60 and having coplanar upper surfaces for the support of a blank 34 thereon with the peripheral flange panels 42 projecting therebeyond. In this regard, note FIGS. 7 and 10.

The forming chamber 54 below the base plate 60 is defined by a series of vertically depending flat bars 64 having a series of horizontal serrations 66 vertically along the inner faces thereof. The serrated bars 64 are arranged to define the basic rectangular configuration of the forming chamber 54, normally at least three such bars being provided along each side of the chamber. The serrations 66 are specifically provided for cooperative engagement with the formed containers 32 as shall be explained subsequently. The depending serrated bars 64 include a central bar 64A along each end or short side of the chamber 54 which is slightly inwardly offset or enlarged for engagement within the opposed container flange notches 44 and into direct engagement with the corresponding upper edges of the end walls 38. The remainder of the serrated bars 64, as will be appreciated from FIG. 6, are positioned for direct engagement with the outer edges of the container flanges 42.

In order to assist in properly locating the blanks 34 on the breaker blocks 62 in overlying relation to the forming chamber 54, a pair of opposed blank locators 68 are provided, one centrally along each end or short side of the chamber opening immediately outward of the corresponding breaker block 62. Each locator 68 is basically an angle member with the horizontal leg 70 bolted to the base 60 and with the vertical leg 72 engaged with or immediately adjacent the corresponding breaker block 62. The inner face of the vertical leg 72 of the locator 68 is provided with a series of serrations, similar to the serrations 66, to engage the outer edges of the blank side walls panels 38 within the flanged notches 44 as noted in FIGS. 7 and 10 to stabilize the blanks as the transfer head 52 is withdrawn and prior to engagement of the forming assembly 58. As desired, the horizontal leg 70 of each locator 68 may include an elongate slot therein receiving the mounting bolt to provide for a degree of adjustability in positioning the locator.

Figure 7:
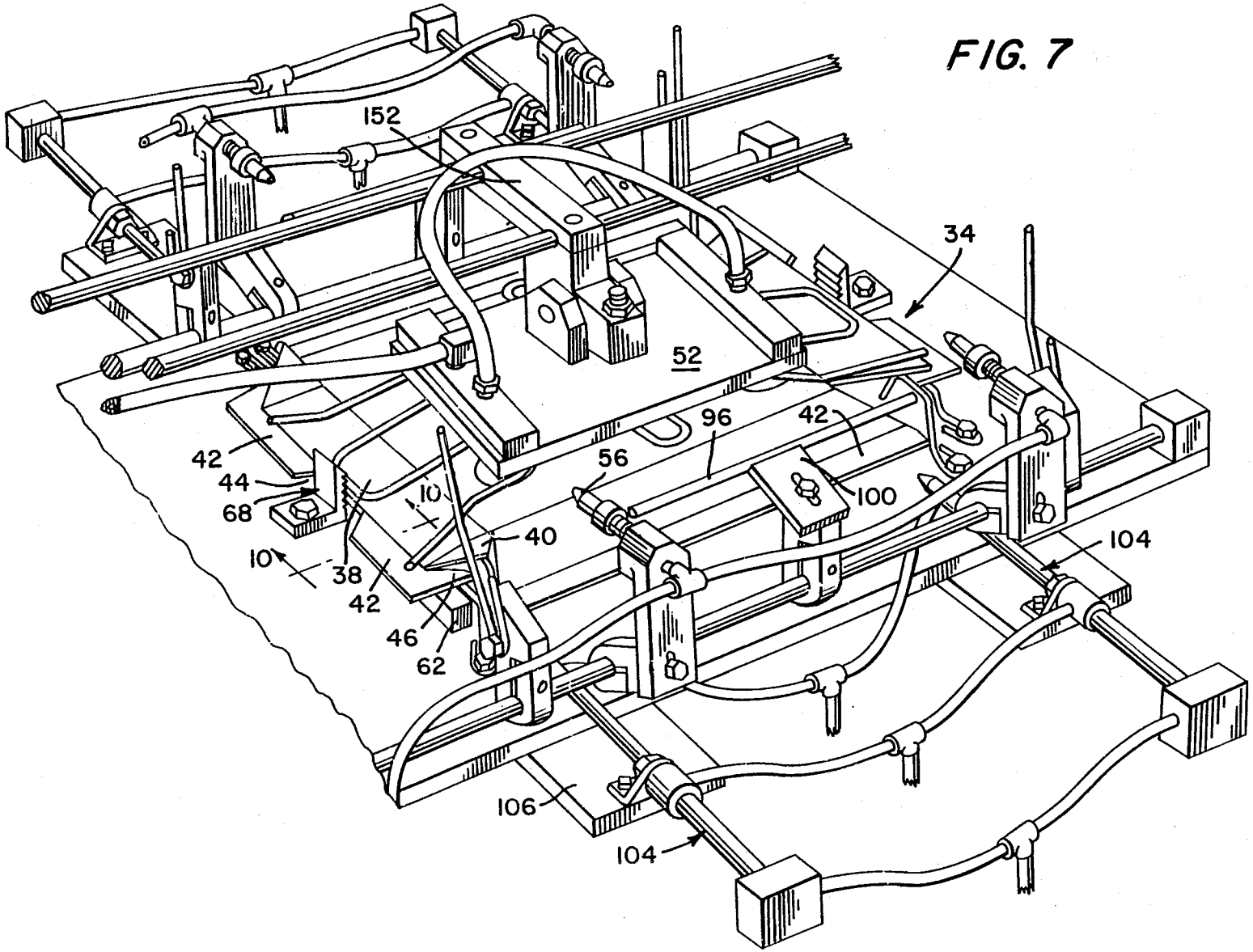
FIG. 7 is a perspective view similar to FIG. 6 with the vacuum plate positioning a blank on the breaker blocks about the forming chamber.
Figure 13:
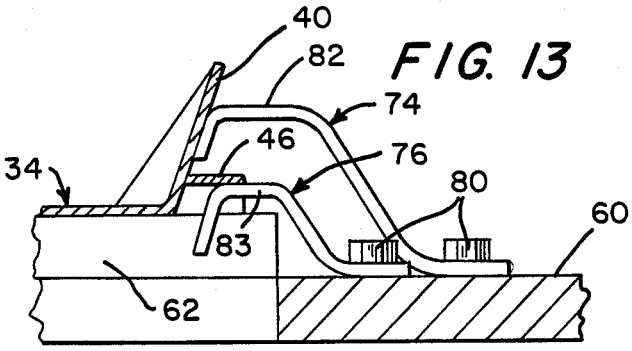
FIG. 13 is a cross-sectional detail illustrating positioning rods positioning the glue flaps.
Figure 18:
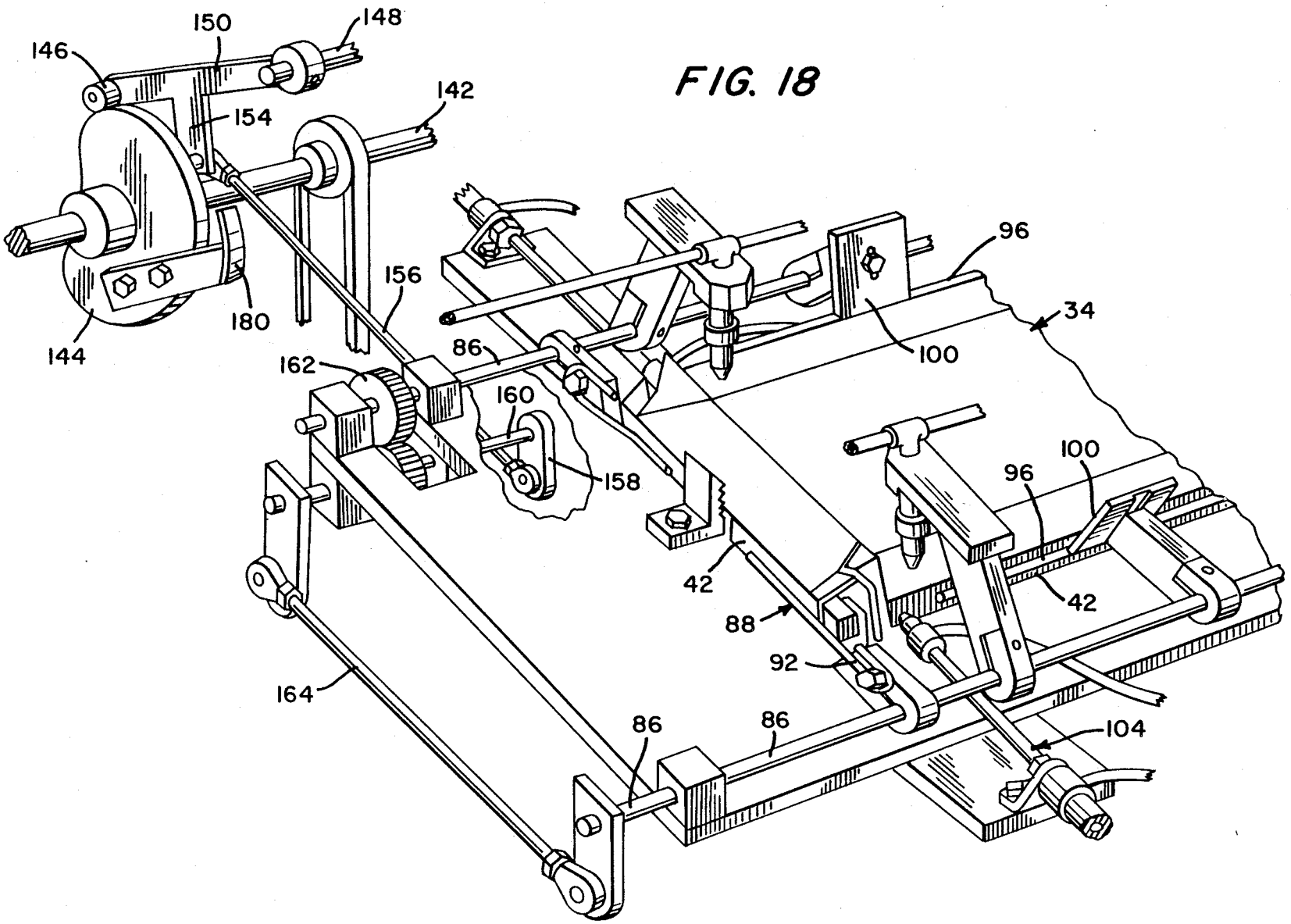
FIGS. 18–21 detail selected features of the control system.

Noting FIGS. 7 and 13, in order to properly position the glue tabs 40 and flange glue flaps 46 of the blanks 34 prior to a folding of the blanks, a pair of deflectors 74 and 76 are provided at each of the corners of the chamber 54, projecting inwardly of the open upper end thereof immediately inward of and generally parallel to the end breaker blocks. As required, the longer side breaker blocks 62 can terminate short of the end breaker blocks 62 at the corners of the chamber mouth to define small gaps for the accomodation of the deflectors 74 and 76.

Each of the deflectors 74 and 76 is in the nature of a rigid bent rod having a slot-defined foot portion which is secured to the base 60 by appropriate bolt means 80 for a degree of adjustment limited by the length of the defined slot. Each of the rods in turn include an upwardly arcing deflecting portion, 82 and 83 respectively, extending inwardly into overlying relation to the chamber mouth positioned to respectively engage corresponding glue tabs 40 and flange flaps 46 as the blank 34 is being depositied on the planar upper surfaces of the breaker blocks 62 and over the forming chamber 54. The deflector 74 of each pair of deflectors is located laterally inward of the companion deflector 76 relative to the ends of the chamber 54 and has a substantially higher deflecting portion 82 for engagement with and a substantially vertical upward folding of the corresponding glue tab 40 while the substantial lower deflecting portion 83 of the deflector 76 simultaneously upwardly deflects the flange glue flap 46 to a substantially lesser degree which is nevertheless sufficient to ensure a proper positioning and overlapping of the flange corners.

As in the prior art apparatus 18, the apparatus 48 of the present invention includes glue tips 56 mounted for a pivotal rotation toward and away from a positioned blank 34 immediately prior to a folding of the walls or wall panels 38 thereof. The glue tips 56 are mounted, through an appropriate mounting assembly 84 of adjustable blocks, on a pair of elongate shafts 86 rotatably supported in overlying relation to the base 60 in outwardly spaced parallel relation to the opposed longitudinal sides of the chamber 54 in a manner whereby rotation of the shaft 86 will engage the tips 56 against the portions of the blank wall panels 38 which are to be subsequently overlapped by the glue tabs 40. As illustrated in the formation of a single compartment container 32, four such pivotally mounted glue tips 56 are provided. In the formation of dual compartment of clamshell type containers additional glue tips, similarly mounted on the shafts 86 and pivotally moved thereby, can be provided. To facilitate dispensing of the glue, the tips will normally include ball valves which automatically open upon engagement.

The present invention proposes the unique utilization of the shafts 86 for the pre-positioning or breaking of the flanges simultaneously with the application of the wall-securing glue, thus providing a significant additional manipulative step without in any way impairing or slowing the operation of the apparatus, while at the same time adapting the apparatus for use in assembly of a distinctly improved container.

Figure 11:
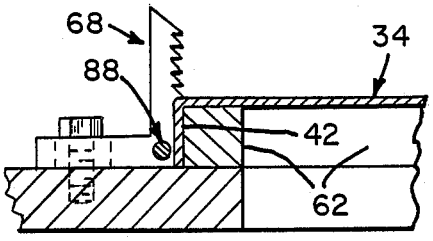
FIG. 11 is a cross-sectional detail taking substantially on a plane passing along line 11—11 in FIG. 8 and illustrating the initial folding of a flange by a breaker rod.

More particularly, each of the simultaneously operative shafts 86 has a pair of end breaker bars or rods 88 mounted thereon for both longitudinal and rotational adjustment by means of appropriate clamping blocks 90. Each end breaker rod 88 includes an elongate slot-defining mounting portion 92 which is slidably adjustable relative to the clamping block 90 by an appropriate clamping bolt 94 to both rotatably and longitudinally adjust the specific position of the breaker rod 88. The operative portion of each of these ends breaker rods 88, that is the portion beyond the slot-defining mounting end, is substanitally linear and adapted, upon rotation of the corresponding shaft 86, to pivot downwardly immediately adjacent the outer vertical face of the corresponding end breaker block 62, thus engaging and downwardly breaking the corresponding end flange 42 of the blank 34, note FIGS. 8 and 11. As will be appreciated from the drawings, each of the end breaker rods 88 terminates short of the central blank locators 68 while at the same time being of sufficient length to ensure a complete downward breaking of the corresponding flange. This breaking of the flanges is facilitated by appropriate score lines or fold lines defined in the blank itself.

Figure 8:
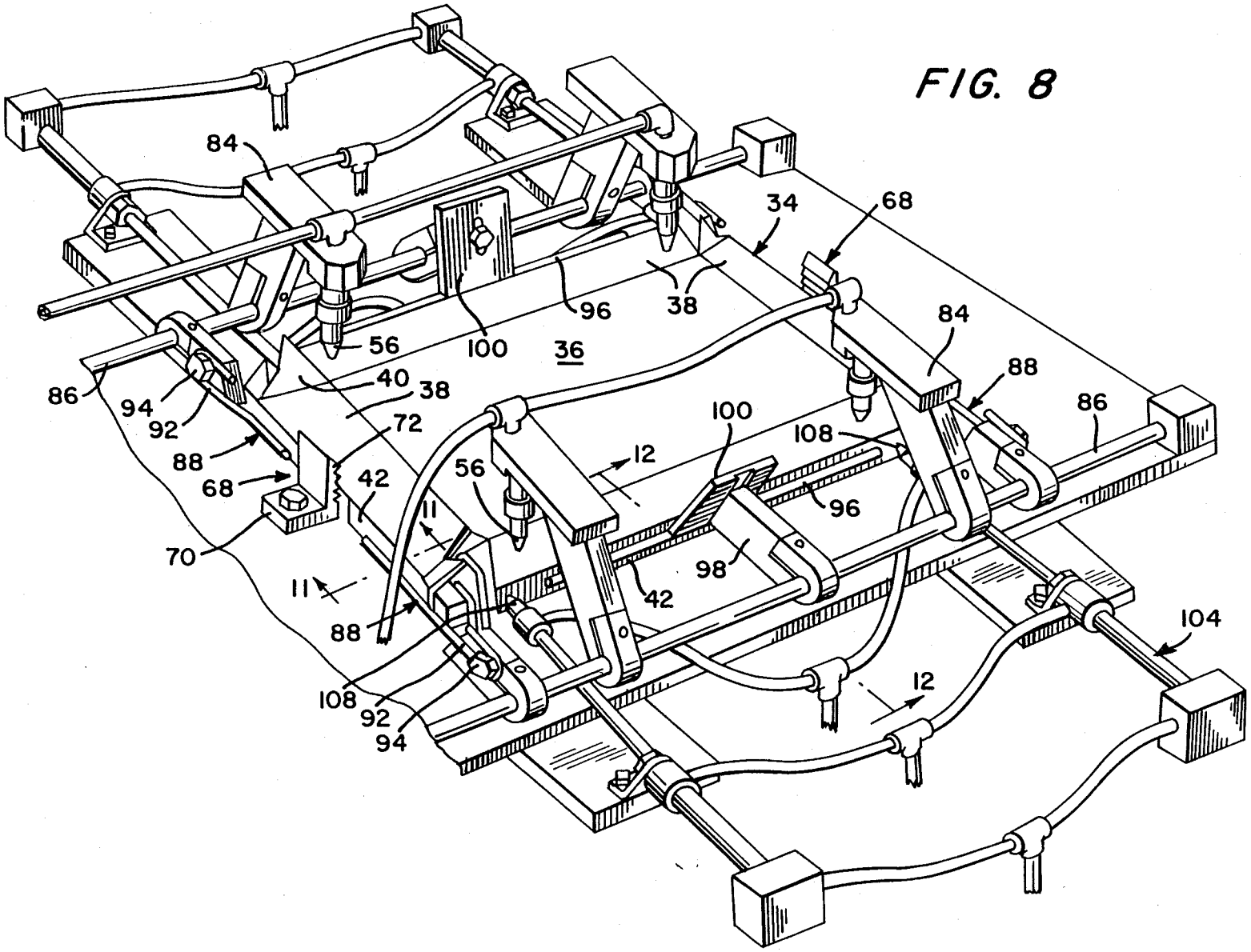
FIG. 8 is a perspective view to FIG. 7 with the vacuum plate retracted and the breaker bars and glue tips activated to prebreak the flanges and apply glue thereto.
Figure 12:
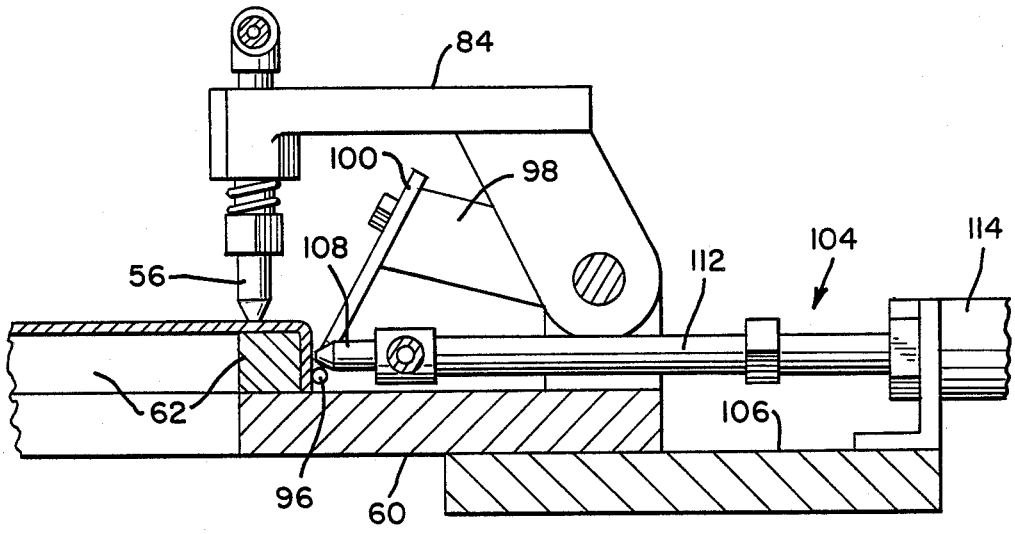
FIG. 12 is a cross-sectional detail taken substantially on a plane passing along line 12—12 in FIG. 8 and illustrating a further breaker rod with associated glue-tips positioned for glue application.

The longitudinal flanges 42 of the blank 34, along the elongate sides thereof, are downwardly folded or broken by one or more intermediate breaker rods 96 oriented parallel to each shaft 86 and adjustably mounted thereon through appropriate clamping blocks 98. Each of the intermediate rods 96 is rigidly secured as by welding, to a laterally projecting slotted mounting plate 100 which is adjustably bolted to the inclined upper end face of the corresponding clamping block 98. Each rod 96 is positioned and adjusted, through the adjustable plate 100 and adjustable clamping block 98, whereby upon a rotation of the shaft 86 the rod 96 will pivot downwardly to engage the corresponding edge flange 42 immediately outward of the corresponding side block 62 for a downward breaking or folding of the flange, as illustrated in FIGS. 8 and 12. In order to provide for a proper breaking of the flanges 42, the breaker blocks 62 should be of a heighth at least as great as the transverse heighth of the flanges 42.

As previously noted, the glue tips 56 conventionally incorporate ball valves for pressure release of glue upon engagement with the blank wall panels 38 at those points thereon to be overlapped by the glue tabs 40. This, noting FIGS. 8 and 12, is effected simultaneously with the breaking of the blank flanges 42. As suggested in the drawings, the glue-tips can be pressure fed through appropriate supply lines 102.

Figure 3:
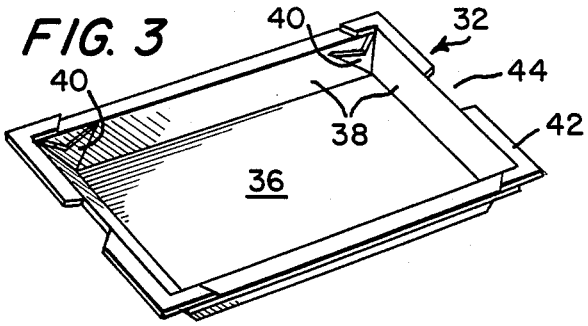
FIG. 3 is a perspective view of a flanged tray formed by the apparatus of the invention.
Figure 4:
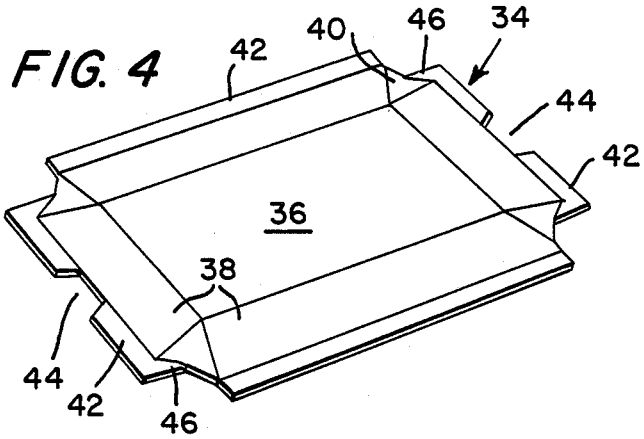
FIG. 4 is a perspective view of a diecut blank form which the tray of FIG. 3 is formed.

As will be appreciated from the finished container of FIG. 3, the flanges 42 are also to be adhesively secured or glued. In order to effect this, the improved apparatus of the invention is provided with a series of horizontally reciprocating glue applicators 104. Each applicator 104 mounts horizontally on the base 60, or an appropriate extension 106 thereof, and presents a ball valve or pressure release glue tip 108 in horizontal alignment with a corresponding portion of the outer surface of a downwardly folded or broken side flange 42 which, in the completed container, is to be overlapped by a corresponding glue flap 46 on an adjacent folded end flange 42. In the formation of a single compartment tray as illustrated, four glue applicators 104 are provided parallel to the end breaker blocks 62 in inwardly spaced closely adjacent relation to the tab and flange flap deflectors 74 and 76. Each of the applicators 104 has the glue tip 108 thereof, supplied through an appropriate glue line 110, mounted on the forward end of a piston rod 112 controlled for reciprocal movement by an associated fluid powered cylinder 114. Noting FIG. 12, it will be appreciated that each reciprocating applicator 104 will, upon forward extension thereof, bring the glue tip 108 into glue depositing position with the aligned portion of the flange 42. The flange 42 is in turn backed by the vertical outer face of the associated breaker block 62 to define a positive bearing surface for the glue applicator.

Subsequent to the initial downward breaking or forming of the flanges 42 and the application of glue by the respective sets of glue-tips 56 and 108, the blank 34 is folded into its container configuration, bringing the glue tabs 40 and flange flaps 46 into bonding engagement with the previously applied glued spots or areas. Noting FIGS. 9 and 14–17 in particular, the forming assembly 58 includes a forming head 116 generally similar to and operationally controlled in the same manner as the convention forming head utilized in the formaton of folded containers without flanges. The apparatus 48 of the invention uniquely differs from the known apparatus in that the forming assembly 58 includes, in addition to the forming head 116, a flange setter assembly 118.

The forming head 116 includes a container-shaping block 120 mounted on the lower end of a support shaft or column unit 122 depending from mounting apparatus, including horizontal shaft 123, for vertical reciprocation of the forming assembly. The configuration of the shaping block 120 is determined by that of the blank and the container formed therefrom. Noting the sequential FIGS. 14, 15, and 16, as the forming head 116 progressively descends toward the supported blank with the prebroken flanges, the block engages the bottom panel 36 and progressively downwardly moves the blank into the forming chamber 54, progressively inwardly folding the wall panels 38 which simultaneously brings the glue tabs 40 into overlying relation to the previously applied glue. The flange panels 42, in turn, are inwardly drawn with the flap-corners thereof overlapped for adherance by the previously applied glue. As will be appreciated with regard to both the glue tabs 40 and the flange glue flaps 46, the initial deflection thereof by the deflecting rods 74 and 76 assures a proper overlapping.

In order to ensure a proer positioning of the flanges both relative to each other and within the forming chamber 54 until such time as the glue has had sufficient time to properly set, the forming assembly utilizes the flange setter assembly 118. This setter assembly 118 includes a base panel 124 provided in parallel overlying relation to container shaping block 120 for vertical movement relative thereto. Noting in particular FIG. 9, the base panel 124 will incorporate a central opening 126 therethrough to accomodate the support column unit 120 of the forming assembly 58. As illustrated, the column unit and base panel aperture 126, have a complimentary rectangular configuration to maintain a non-rotational parallel relationship between the base panel 124 and the underlying shaping block 120.

The setter assembly 118 further includes depending setting bars 128 affixed peripherally about and depending below the edges of the base panel 124 in laterally outwardly spaced relation to the peripheral edges of the underlying forming head shaping block 120.

Figure 9:
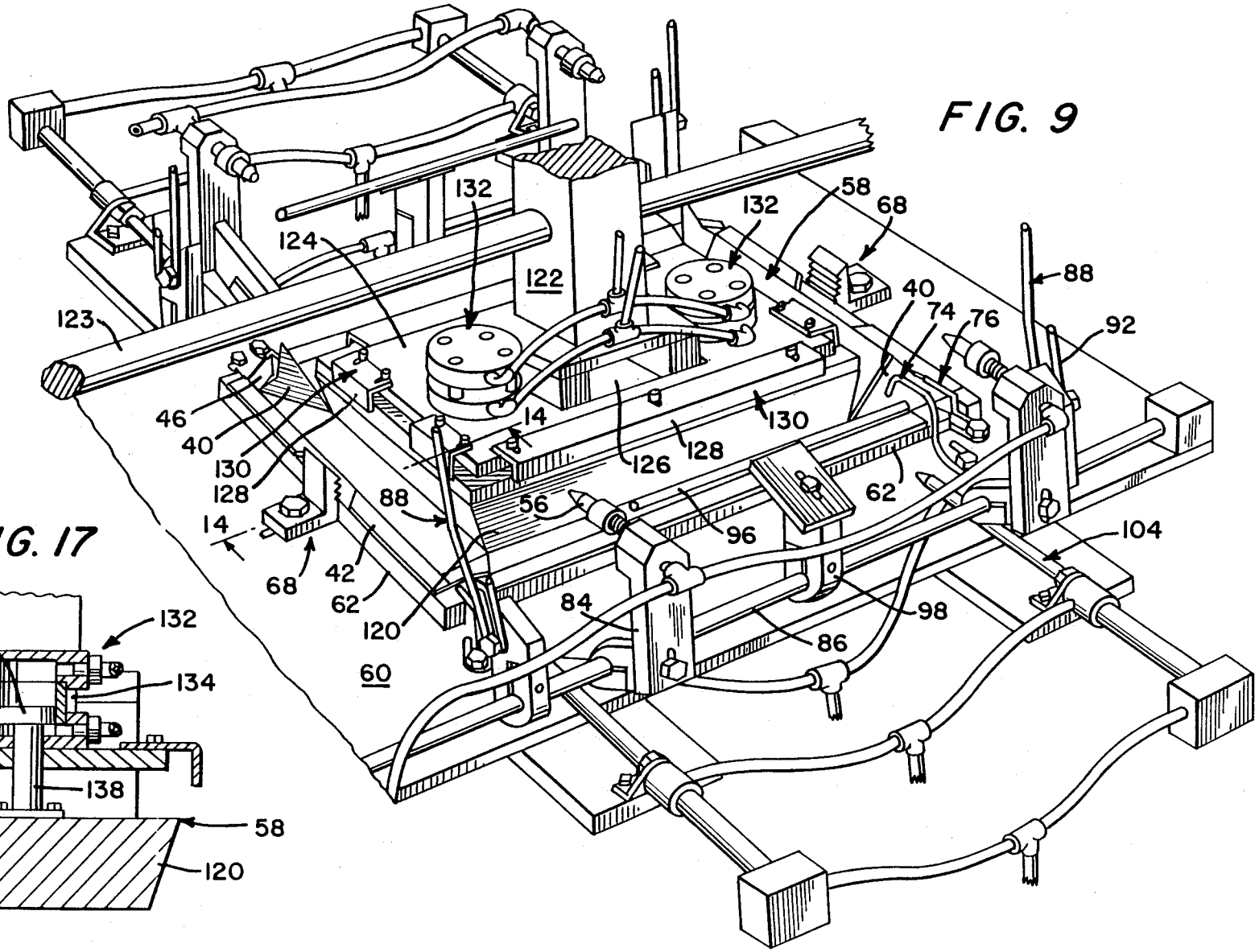
FIG. 9 is a similar perspective view with the breaker bars and glue tips retracted and the forming assembly engaging the blank.
Figure 17:
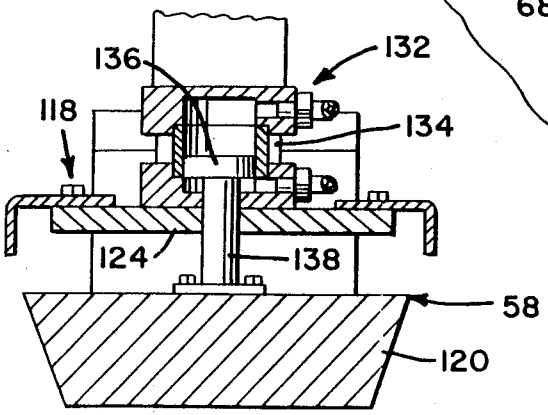
FIG. 17 is a cross-sectional detail taken through the forming assembly and illustrating the control means for the flanger setter.

As suggested in FIG. 9, the setting bars 128 can comprise the vertical legs of angle members 130, the horizontal legs of which overlie the edge portions of the base panel 128 and are adjustably bolted thereto.

Noting FIGS. 9 an 17, vertical reciprocation of the setter assembly 118 relative to the forming head 58 is effected by means of a pair of fluid or hydraulic assemblies 132. Each assembly 132 includes a cylinder 134 appropriately secured to the upper surface of the base panel 124 and receiving the head 136 of a piston 138 depending vertically therefrom through the base panel 124 and into fixed engagement with the shaping block 120 whereby selective extension and retaction of the piston 138 relative to the associated cylinder unit 134 will effect a corresponding vertical reciprocation of the setter assembly 118 relative to the shaping block 120. As previously noted, the central column unit 122 of the forming head can provide guidance for the vertical reciprocation of the setter assembly.

Figure 15:
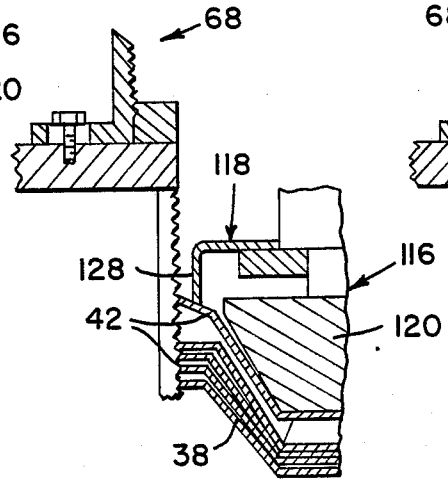
FIG. 15 illustrates the forming assembly with the forming head seating the newly formed container into the previously formed containers.
Figure 16:
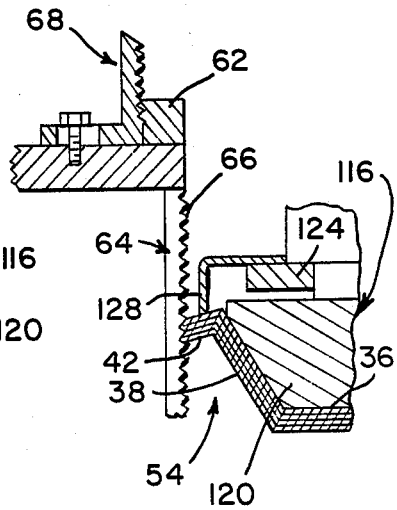
FIG. 16 is a sequential cross-sectional detail with the flange setter of the forming assembly downwardly moved to position the flanges and nest the formed container.

Noting FIGS. 15 and 16, after the shaping block 120 has initially folded the blank 34 inward of the forming chamber 54, the setter assembly moves downward relative to the shaping block 120, either as the shaping block continues movement to its lowermost position or subsequent to arrival at its lowermost position. This downward movement of the setter assembly 116 brings the setting bars 128 into engagement with the folded flanges 42 to move these flanges from an upwardly and outwardly inclined orientation naturally assumed as the blank is forced within the forming chamber to a downwardly folded position slightly below the horizontal as noted in FIG. 16. So positioned, the flanges 42 are effectively engaged by the serrations 66 on the inner faces of the vertical chamber bars 64 for a positive retention of the flanges with the flaps thereof positioned for adhesive bonding and in a manner precluding any tendency for the newly formed container to vertically rise in the chamber. The final configuration of the container is effected by the nesting of each folded blank within a previously folded blank with the formed containers stacking within the forming chamber and retained for sequential downward movement by the serrated inner faces of the bars 64. While not illustrated, the lower end of the forming chamber 54 ultimately discharges into a collection means, for example a discharge chute, for the completed containers with the dwell time of the containers within the forming chamber being such as to ensure a positive bonding.

The operating system of the apparatus is generally schematically presented in FIGS. 18–21. A power unit, for example electric motor 140, rotatably drives a main drive shaft 142. The shaft 142 mounts a kidney-shaped cam 144. A cam follower 146 rides on the cam 144 and pivotally controls a driven shaft 148 for oscillation thereof through a rigid link 150. The vacuum transfer head 52, through an appropriate pivoting arm assembly 152, is affixed to the driven shaft 148 for a timed transfer of the blanks from the feed 50 to the forming chamber 54 in response to oscillation of driven shaft 148.

A link arm 154, rigid with the follower-controlled link 150, provides for a cam-controlled rotation of the dual shafts 86 which mount the glue assemblies and breaker rods. Basically, an elongate link 156 extends from the outer end of the link arm 154 to a pivot arm 158. The picot arm 158, through an appropriate mounting shaft 160, and reversing gear assembly 162, oscillates a first one of the shafts 86. The second shaft 86 is simultaneously oscillated by means of a tie rod assembly engaged therewith and with shaft 160 for simultaneous coordinated pivoting of both of the opposed combination glue applicator and breaker rod assemblies. Intimate engagement of the follower 146 with the cam 144 is provided by appropriate spring means, for example a tension spring 166 engaged with the free end of the link arm 154 and a rigid portion of the framework of the apparatus.

The main drive shaft 142, as it rotates, also provides for the timed reciprocation of the forming head assembly 58. Basically, and as suggested in FIG. 19, a first link 168 is rigid with the main drive shaft 142 at one end thereof. A second link 170 is pivoted to the outer end of the first link 168 and in turn joined to an elongate transverse link 172 which has a first end pivoted, as at 174, to the frame of the apparatus and the second end pivoted to the lower end of a vertical rod 176. The upper end of the rod 176 is secured to a vertical slide 178 which mounts the forming head assembly 58 for reciprocation in timed sequence. As desired, the linkage arrangement 168–178 can be duplicated at the opposite end of the shaft 142, as in fact can the aforedescribed controls with regard to the vacuum transfer head assembly and the pivoting glue applicator and breaker rod assemblies.

Affixed to the cam 144 and rotatable therewith is an arcuate switch actuator 180 which, in proper timed sequence, engages switch 182 for a controlled actuation of the flange-engaging horizontally directed glue applicators 104 for a sequential extension and retraction into engagement with the vertically positioned container flanges 42 immediately subsequent to the downward folding or breaking of the flanges and either while the breaker rods are still in contact with the flanges or immediately subsequent to withdrawal of the breaker rods.

Figures 19, 20, 21:
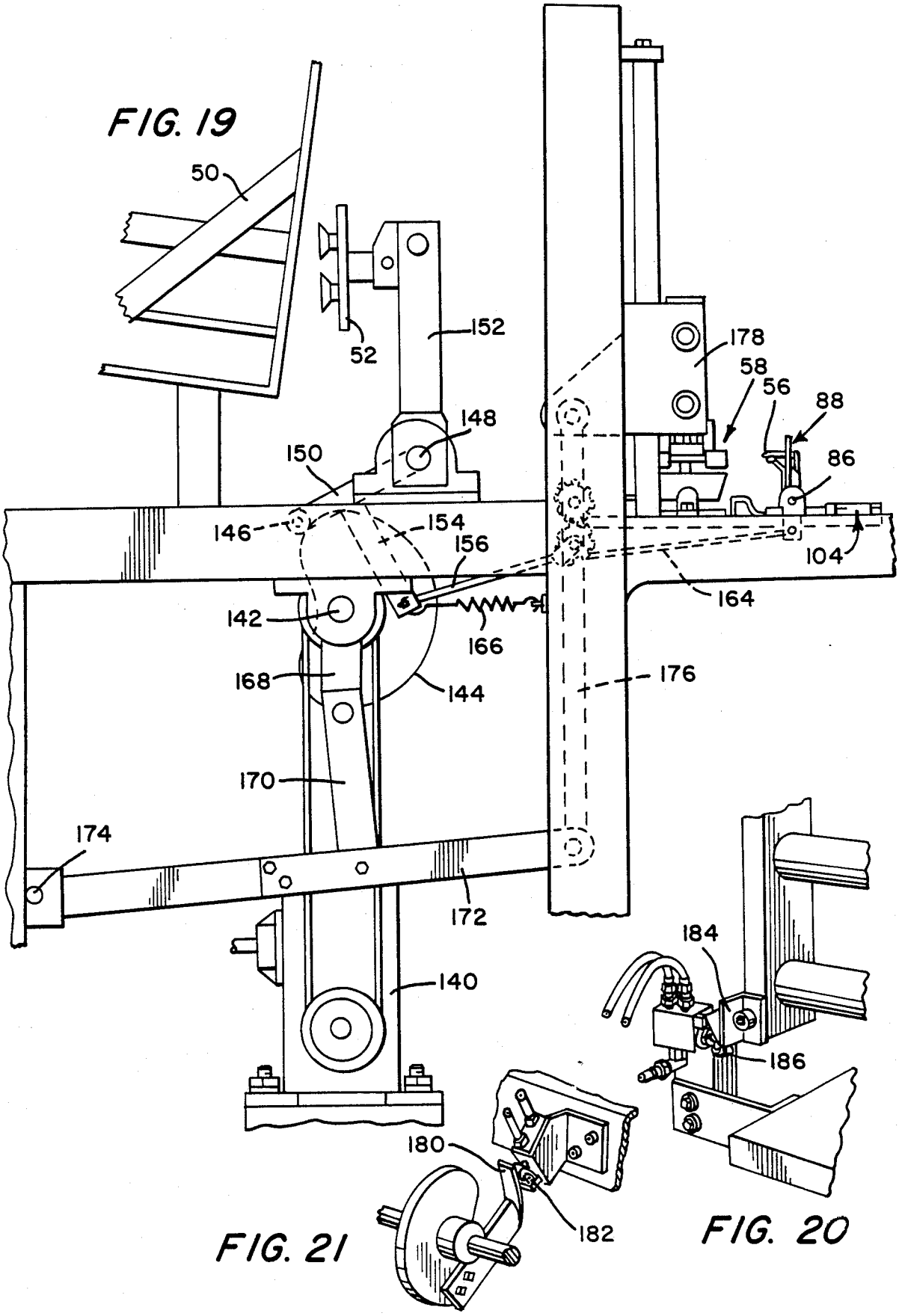

After the forming head assembly has moved downward to engage the container shaping block 120 with the block 34 subsequent to the prebreaking of the flanges 42, the flange setter assembly is activated to downwardly set the flanges within the forming chamber. Activation of the setter assembly is hydraulic and, noting FIG. 20, is effected by engagement of an appropriated switch operator 184 mounted on the support for the forming head assembly and engageable as the assembly moves downward with an appropriate switch mechanism 186. The movement of the setter assembly may be synchronized with the forming head generally as sequentially illustrated in FIGS. 15 and 16. Additional controls, limit switches, reversing switches, and the like may be provided as desired or required.

Formation of the flanged containers in accord with the present invention involves a sequence of steps performed by high speed apparatus which automatically folds preformed blanks into finished containers. Initially, an individual blank is withdrawn from a gravity feed mechanism and positioned horizontally over the forming chamber in supported engagement or peripheral shoulder-defining breaker blocks 62 with peripheral flange panels 42 on the blank projecting beyond the blocks 62. The projecting flange panels are downwardly folded to depend from the planar blank peripherally thereabout. Glue is applied at the downwardly formed flanges as well as wall-defining panels immediately inward thereof. The blank is then downwardly moved into the forming chamber with the sides of the chamber, in cooperation with the blank-moving forming head, inwardly folding the walls of the container, bringing the areas to be adhesively bonded into overlapping engagement. As the basic container is being formed, the peripheral flanges are downwardly forced, both ensuring a proper orientation thereof to overlap the areas to be adhesively bonded, and to also position the flanges into container-securing engagement with the serrated inner faces of the forming chamber walls or wall-defining bars. It is contemplated that the formed containers nest within previously formed containers in a continuing operation whereby cooperation therewith and with the flange-retaining serrations provides a container-stabilizing support unitl such time as the glue has set.

The formed containers progressively travel downward through the forming chamber with the length of travel being such as to ensure a proper setting of the glue. The formed containers are ultimately discharged through the bottom of the forming chamber into, as an example, an appropriate discharge chute.

The foregoing is considered illustrative of the features of the invention as applied to the formation of a single-compartment container. Modifications as required and within the scope of the invention for variations in container configuration and the like will be apparent to those skilled in the art.

We claim:

1. In apparatus for forming paperboard blanks into containers with depressed central compartments defined by peripheral walls, and outwardly projecting peripheral flanges about said walls, said blanks having peripheral flange-defining edge panels anad wall-defining intermediated panels immediately inward of said edge panels, said apparatus including a forming chamber with an upwardly directed receiving opening, positioning means for positioning a blank over said receiving opening, glue applicator means, and vertically reciprocating container forming means for engaging the blank positioned over said receiving opening and moving said positioned blank into said chamber with the intermediate panels folding upward to define the walls; the improvement comprising flange forming means including flange folding means mounted above said chamber for engaging and downwardly folding the edge panels of the blank positioned over said receiving opening prior to the movement of said blank into said chamber and prior to the upward folding of said intermediate panels, said upward folded edge panels defining the outwardly projecting flanges peripherally about the defined walls upon the upward folding of said intermediate panels.

2. In the apparatus of claim 1, wherein said glue applicator means includes first vertical glue applicator means adjacent said forming chamber for applying glue to said intermediate panels, positioned over said receiving opening and prior to the folding thereof; the improvement wherein said glue aplicator means further includes second horizontal glue applicator means adjacent said forming chamber and horizontally reciprocal in alignment with and for glue-applying engagement with said folded edge panels at said receiving opening and prior to the folding of said intermediate panels.

3. In the apparatus of claim 2, said chamber including vertical elongate container-defining members; the improvement further comprising retainer means on said container-defining members for engaging said flanges and retaining said containers for progressive downward movement in said chamber by said vertically reciprocating container forming means.

4. In the apparatus of claim 3, the flange forming means further comprising flange setter means selectively vertically reciprocal within said chamber for engaging and downwardly setting said flanges in retained engagement with said retainer means.

5. In the apparatus of claim 4, said flange folding means comprising shoulder-defining means peripherally about said receiving opening for receiving a positioned blank in supported position thereon with the edge panels of said blank projecting peripherally beyond said shoulder-defining means, and breaker means vertically reciprocal immediately outward of said shoulder-defining means for engagement with and downward folding of said edge panels about said shoulder-defining means.

6. In the apparatus of claim 5, said first vertical glue applicator means comprising a pair of vertically reciprocating applicator assemblies generally paralleling and mounted immediately outward of opposed sides of the receiving opening, and glue applying tips on each assembly selectively engaging with a positioned blank upon reciprocation of the assembly; the emprovement further comprising said edge panel breaker means mounted on each of said applicator assemblies for reciprocation therewith into folding engagement with the edge panels of a positioned blank substantially simultaneously with engagement of said glue applying tips.

7. In the apparatus of claim 6, wherein each applicator assembly includes an oscillating shaft, said breaker means comprising elongate breaker rods mounted on said shaft for selective reciprocation toward and away from a positioned blank upon oscillation of said shaft, selected ones of said breaker rods extending generally perpendicular to the shaft, the remainder of said breaker rods paralleling said shaft in outwardly spaced relation thereto.

8. In the apparatus of claim 7, each of said breaker rods being mounted on the corresponding shaft for both longitudinal and lateral adjustment relative thereto.

9. In the apparatus of claim 8, wherein said positioning means includes vertically projecting deflectors adjacent said upwardly directed receiving opening and at spaced points thereabout for engagement with and upward deflection of selected portions of the edge panels of a positioned blank to facilitate overlapped folding of flanges defined from said edge panels.

10. In the apparatus of claim 9, said positioning means further including blank locator means positioned adjacent a pair of opposed sides of said receiving opening, said locator means projecting vertically upward beyond the corresponding shoulder-defining means and having inwardly directed surfaces adapted to engage opposed edges on a positioned blank.

11. In the apparatus of claim 10, said second horizontal glue applicator means being horizontally aligned with selected shoulder-defining means whereby the shoulder-defining means forms a rear support for the downwardly folded edge panels as the second horizontal glue applicator means are horizontally reciprocated into glue-applying engagement with said folded edge panels.

12. In the apparatus of claim 11, wherein said container-defining members comprise vertical bars with inwardly directed inner faces, said retainer means comprising horizontally extending serrations vertically spaced along at least a substantial portion of each of said bars for container retaining engagement with the folded flanges as the containers are progressively moved downward through said chamber.

13. In the apparatus of claim 12, said vertical bars including a central bar along each of a pair of opposed sides of the chamber, each central bar projecting inwardly relative to the remaining bars of the corresponding side a distance substantially equal to the width of a formed flange for direct engagement with the corresponding wall of a chamber-received container, each said central bar being in inwardly offset vertical alignment with a corresponding locator means.

14. In the apparatus of claim 13, means mounting said flange setter means on said vertically reciprocating container forming means for movement therewith in moving a positioned blank into said chamber to define a container and for movement relative thereto for engaging and downwardly setting the flanges of the formed container.

15. In the apparatus of claim 14, said vertically reciprocating container forming means including a forming head conforming in donfiguration to the desired shape of the container to be formed, said setter means overlying said forming head and including depending peripheral setting bars vertically reciprocal relative to the forming head for engagement with the peripheral flanges of a container formed by said forming head for a downward movement of said flanges.

16. In the apparatus of claim 2, said flange folding means comprising shoulder-defining means peripherally about said receiving opening for receiving a positioned blank in supported position thereon with the edge panels of said blank projecting peripherally beyond shoulder-defining means, and breaker vertically reciprocal immediately outward of said shoulder-defining means for engagement with and downward folding of said edge panels about said shoulder-defining means.

17. In the apparatus of claim 16, said first vertical glue applicator means comprising a pair of vertically reciprocating applicator assemblies generally paralleling and mounted immediately outward of opposed sides of the receiving opening, and glue applying tips on each assembly selectively engaging with a positioned blank upon reciprocation of the assembly; the improvement further comprising said edge panel breaker means mounted on each of said applicator assemblies for reciprocation therewith into folding engagement with the edge panels of a positioned blank substantially simultaneously with engagement of said glue applying tips.

18. In the apparatus of claim 17, wherein each applicator assembly includes an oscillating shaft, said breaker means comprising elongate breaker rods mounted on said shaft for selective reciprocation toward and away from a positioned blank upon oscillation of said shaft, selected ones of said breaker rods extending generally perpendicular to the shaft, the remainder of said breaker rods paralleling said shaft in outwardly spaced relation thereto.

19. In the apparatus of claim 16, the flange forming means further comprising flange setter means selectively vertically reciprocal within said chamber for engaging and downwardly setting said flanges in retained engagement with said retainer means.

20. In the apparatus of claim 3, wherein said container-defining members comprise vertical bars with inwardly directed inner faces, said retainer means comprising horizontally extending serrations vertically spaced along at least a substantial portion of each of said bars for container retaining engagement with the folded flanges as the containers are progressively moved downward through said chamber.

21. In the apparatus of claim 20, said positioning means including blank locator means positioned adjacent a pair of opposed sides of said receiving opening, said locator means projecting vertically upward and having inwardly directed surfaces adapted to engage opposed edges of a positioned blank.

22. In the apparatus of claim 21, said vertical bars including a central bar along each of a pair of opposed sides of the chamber, each central bar projecting inwardly relative to the remaining bars of the corresponding side a distance substantially equal to the width of a formed flange for direct engagement with the corresponding wall of a chamber-received container, each said central bar being in inwardly offset vertical alignment with a corresponding locator means.

23. In the apparatus of claim 4, means mounting said flange setter means on said vertically reciprocating container forming means for movement therewith in moving a positioned blank into said chamber to define a container and for movement relative thereto for engaging and downwardly setting the flanges of the formed container.

24. In the apparatus of claim 23, said vertically reciprocating container forming means including a forming head conforming in configuration to the desired shape of the the container to be formed, said setter means overlying said forming head and including depending peripheral setting bars vertically reciprocal relative to the forming head for engagement with the peripheral flanges of a container formed by said forming head for a downward movement of said flanges.

* * * * *

UNITED STATES PATENT AND TRADEMARK OFFICE

CERTIFICATE OF CORRECTION

PATENT NO. : 4,832,675

DATED : May 23, 1989

INVENTOR(S) : Norman K. Stearns et al

It is certified that error appears in the above-identified patent and that said Letters Patent is hereby corrected as shown below:

Column 10, line 31, change "anad" to -- and --;

Column 10, line 47, delete "upward";

Column 10, line 56, change "aplicator" to -- applicator --;

Column 11, line 21, change "emprovement" to -- improvement --;

Column 12, line 19, change "donfiguration" to -- configuration --.

Signed and Sealed this

Twenty-seventh Day of March, 1990

*Attest:*

JEFFREY M. SAMUELS

*Attesting Officer*

*Acting Commissioner of Patents and Trademarks*